US011812527B2

(12) United States Patent
Lee

(10) Patent No.: US 11,812,527 B2
(45) Date of Patent: Nov. 7, 2023

(54) LED CONTROL DEVICE AND LIGHTING DEVICE INCLUDING THE SAME

(71) Applicant: SAMSUNG ELECTRONICS CO., LTD., Suwon-si (KR)

(72) Inventor: Bongjin Lee, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/948,701

(22) Filed: Sep. 20, 2022

(65) Prior Publication Data

US 2023/0209677 A1 Jun. 29, 2023

(30) Foreign Application Priority Data

Dec. 27, 2021 (KR) ..... 10-2021-0188580

(51) Int. Cl.
*H05B 45/325* (2020.01)
*H05B 45/37* (2020.01)
*H05B 45/46* (2020.01)

(52) U.S. Cl.
CPC ..... *H05B 45/325* (2020.01); *H05B 45/37* (2020.01); *H05B 45/46* (2020.01)

(58) Field of Classification Search
CPC ..... H05B 45/10; H05B 45/20; H05B 45/325; H05B 45/37; H05B 45/46; H05B 47/10
See application file for complete search history.

(56) References Cited

U.S. PATENT DOCUMENTS

| | | | |
|---|---|---|---|
| 6,372,608 | B1 | 4/2002 | Shimoda et al. |
| 6,645,830 | B2 | 11/2003 | Shimoda et al. |
| RE38,466 | E | 3/2004 | Inoue et al. |
| 6,818,465 | B2 | 11/2004 | Biwa et al. |
| 6,818,530 | B2 | 11/2004 | Shimoda et al. |
| 6,858,081 | B2 | 2/2005 | Biwa et al. |
| 6,967,353 | B2 | 11/2005 | Suzuki et al. |
| 7,002,182 | B2 | 2/2006 | Okuyama et al. |
| 7,084,420 | B2 | 8/2006 | Kim et al. |
| 7,087,932 | B2 | 8/2006 | Okuyama et al. |
| 7,154,124 | B2 | 12/2006 | Han et al. |
| 7,208,725 | B2 | 4/2007 | Sherrer et al. |
| 7,288,758 | B2 | 10/2007 | Sherrer et al. |
| 7,319,044 | B2 | 1/2008 | Han et al. |
| 7,501,656 | B2 | 3/2009 | Han et al. |
| 7,709,857 | B2 | 5/2010 | Kim et al. |

(Continued)

FOREIGN PATENT DOCUMENTS

| | | | |
|---|---|---|---|
| KR | 10-1029546 | B1 | 4/2011 |
| KR | 10-1965249 | B1 | 4/2019 |

*Primary Examiner* — Jimmy T Vu
(74) *Attorney, Agent, or Firm* — Sughrue Mion, PLLC

(57) ABSTRACT

A light emitting diode (LED) control device includes a power supply connected to a first driving node and a second driving node through which an LED driver is configured to supply power to an LED module including a first LED string and a second LED string, a square wave generator that generates a square wave, a duty ratio controller that outputs a control signal based on the square wave, and change a slope of the control signal based on a change in a time constant, and a switch circuit configured to control a ratio of a first current applied to the first LED string and a second current applied to the second LED string based on a change in the slope of the control signal.

20 Claims, 9 Drawing Sheets

(56) References Cited

U.S. PATENT DOCUMENTS

| | | | | |
|---|---|---|---|---|
| 7,759,140 | B2 | 7/2010 | Lee et al. | |
| 7,781,727 | B2 | 8/2010 | Sherrer et al. | |
| 7,790,482 | B2 | 9/2010 | Han et al. | |
| 7,940,350 | B2 | 5/2011 | Jeong | |
| 7,959,312 | B2 | 6/2011 | Yoo et al. | |
| 7,964,881 | B2 | 6/2011 | Choi et al. | |
| 7,985,976 | B2 | 7/2011 | Choi et al. | |
| 7,994,525 | B2 | 8/2011 | Lee et al. | |
| 8,008,683 | B2 | 8/2011 | Choi et al. | |
| 8,013,352 | B2 | 9/2011 | Lee et al. | |
| 8,049,161 | B2 | 11/2011 | Sherrer et al. | |
| 8,129,711 | B2 | 3/2012 | Kang et al. | |
| 8,179,938 | B2 | 5/2012 | Kim | |
| 8,263,987 | B2 | 9/2012 | Choi et al. | |
| 8,324,646 | B2 | 12/2012 | Lee et al. | |
| 8,399,944 | B2 | 3/2013 | Kwak et al. | |
| 8,432,511 | B2 | 4/2013 | Jeong | |
| 8,456,109 | B1 | 6/2013 | Wray | |
| 8,459,832 | B2 | 6/2013 | Kim | |
| 8,502,242 | B2 | 8/2013 | Kim | |
| 8,536,604 | B2 | 9/2013 | Kwak et al. | |
| 8,669,722 | B2 | 3/2014 | Yeh et al. | |
| 8,735,931 | B2 | 5/2014 | Han et al. | |
| 8,766,295 | B2 | 7/2014 | Kim | |
| 9,018,845 | B2 | 4/2015 | Ge et al. | |
| 9,713,217 | B2 | 7/2017 | Bayat et al. | |
| 11,032,885 | B2 | 6/2021 | Huang et al. | |
| 11,116,055 | B2 | 9/2021 | Qiu et al. | |
| 2012/0200231 | A1* | 8/2012 | Esaki ..... | H05B 45/20 315/210 |

* cited by examiner

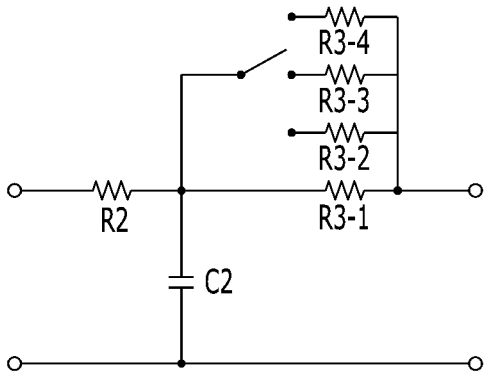
FIG. 5
FIG. 6A
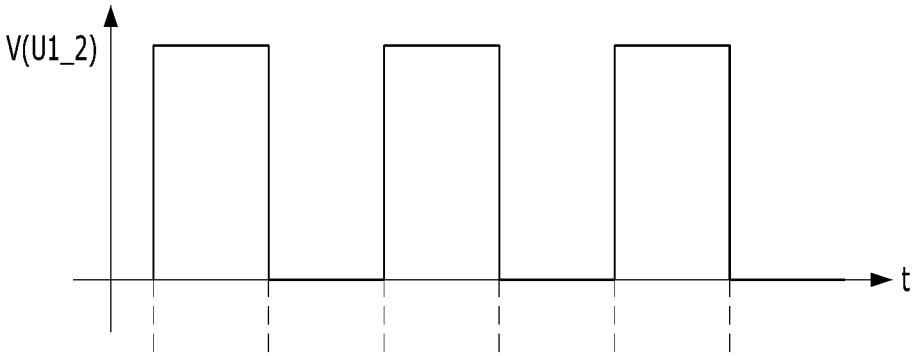
FIG. 6B
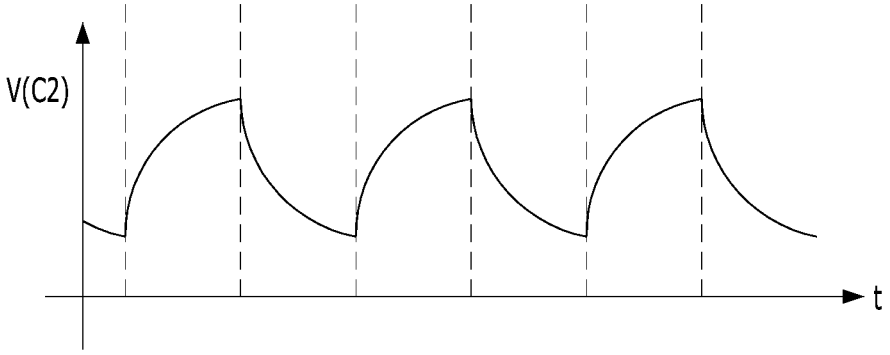

LED CONTROL DEVICE AND LIGHTING DEVICE INCLUDING THE SAME

CROSS-REFERENCE TO RELATED APPLICATION(S)

This application is based on and claims the benefit under 35 USC 119(a) of Korean Patent Application No. 10-2021-0188580 filed on Dec. 27, 2021 in the Korean Intellectual Property Office, the entire disclosure of which is incorporated herein by reference for all purposes.

BACKGROUND

1. Field

The disclosure relates to a light emitting diode (LED) control device and a lighting device including the same.

2. Description of Related Art

Light emitting diodes (LEDs) have advantages such as low power consumption and a long lifespan, and are rapidly replacing fluorescent and incandescent lamps. Recently, various types of lighting devices employing an LED as a light source have been developed and sold. Moreover, research into lighting devices having various functions in addition to the simple lighting function is also being actively carried out. For example, a function capable of controlling the color temperature of light may be mounted in the lighting device.

SUMMARY

Example embodiments provide an LED control device in which a color temperature control function may be implemented at low costs, and a lighting device including the same.

According to an aspect of the disclosure, there is provided a light emitting diode (LED) control device including: a power supply connected to a first driving node and a second driving node through which an LED driver is configured to supply power to an LED module which includes a first LED string configured to output light of a first color temperature and a second LED string configured to output light of a second color temperature; a square wave generator configured to operate based on a first internal power supply voltage output from the power supply and generate a square wave; a duty ratio controller configured to output a control signal based on the square wave, and change a slope of the control signal based on a change in a time constant; and a switch circuit configured to operate based on a second internal power supply voltage output from the power supply, and control a ratio of a first current applied to the first LED string and a second current applied to the second LED string based on a change in the slope of the control signal.

According to another aspect of the disclosure, there is provided a light emitting diode (LED) control device including: a power supply connected to a first driving node and a second driving node through which an LED driver is configured to supply power to an LED module which includes a first LED string and a second LED string connected to each other in parallel and configured to emit light having different color temperatures; a square wave generator configured to generate a square wave; a duty ratio controller configured to output a control signal based on the square wave, and change a slope of the control signal based on a change in a time constant; and a switch circuit including: a first switch driver configured to output a first pulse width modulation (PWM) signal of which trigger timing is changed according to a change in the slope of the control signal output from the duty ratio controller, a second switch driver configured to invert the first PWM signal into a second PWM signal, and output the second PWM signal, a first switch element configured to control a first current supplied to the first LED strings based on the first PWM signal, and a second switch element configured to control a second current supplied to the second LED strings based on the second PWM signal.

According to another aspect of the disclosure, there is provided a lighting device including: a light emitting diode (LED) driver configured to generate a driving power for driving LEDs using alternating current (AC) power and output the driving power through a first driving node and a second driving node; an LED module configured to be turned on by the driving power, and including a first LED string configured to emit light of a first color temperature and a second LED string configured to emit light of a second color temperature; and an LED control device including: a power supply connected to the first driving node and the second driving node, a square wave generator configured to generate a square wave, a duty ratio controller configured to output a control signal based on the square wave, and change a slope of the control signal based on a change in a time constant, and a switch circuit configured to control a ratio of a first current applied to the first LED string and a second current applied to the second LED string based on a change in the slope of the control signal.

BRIEF DESCRIPTION OF DRAWINGS

The above and other aspects, features, and advantages of the disclosure will be more clearly understood from the following detailed description, taken in conjunction with the accompanying drawings, in which:

FIG. 5 is a modified example of a duty ratio controller of FIG. 3;

FIGS. 6A, 6B, 7A, 7B, 7C, 8A, 8B and 8C are diagrams illustrating signals output from respective parts of an LED control device according to an example embodiment;

DETAILED DESCRIPTION

Hereinafter, example embodiments will be described with reference to the accompanying drawings.

Figure 1:
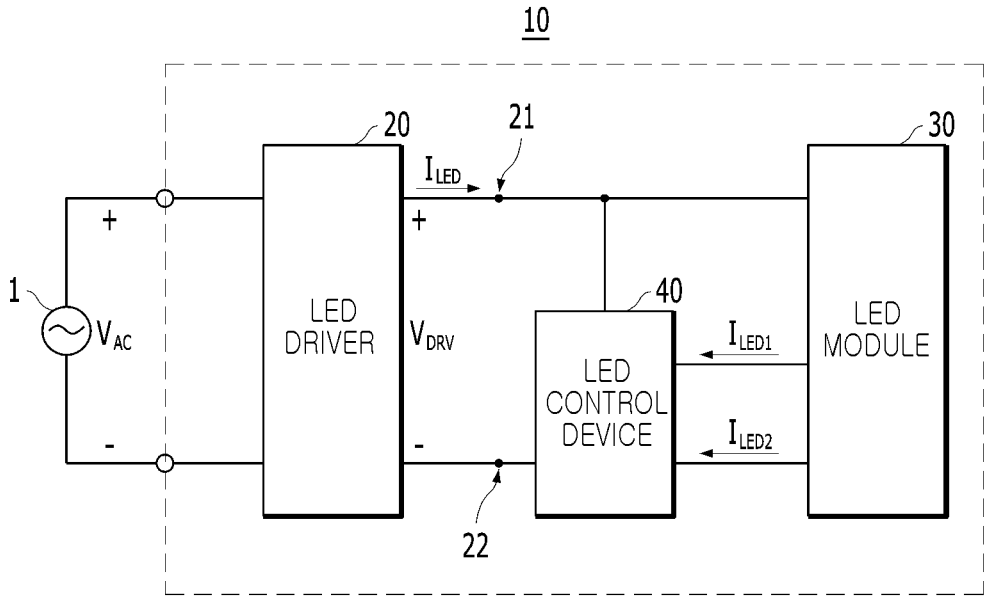
FIG. 1 is a block diagram schematically illustrating a lighting device according to an example embodiment.
Figure 2A:
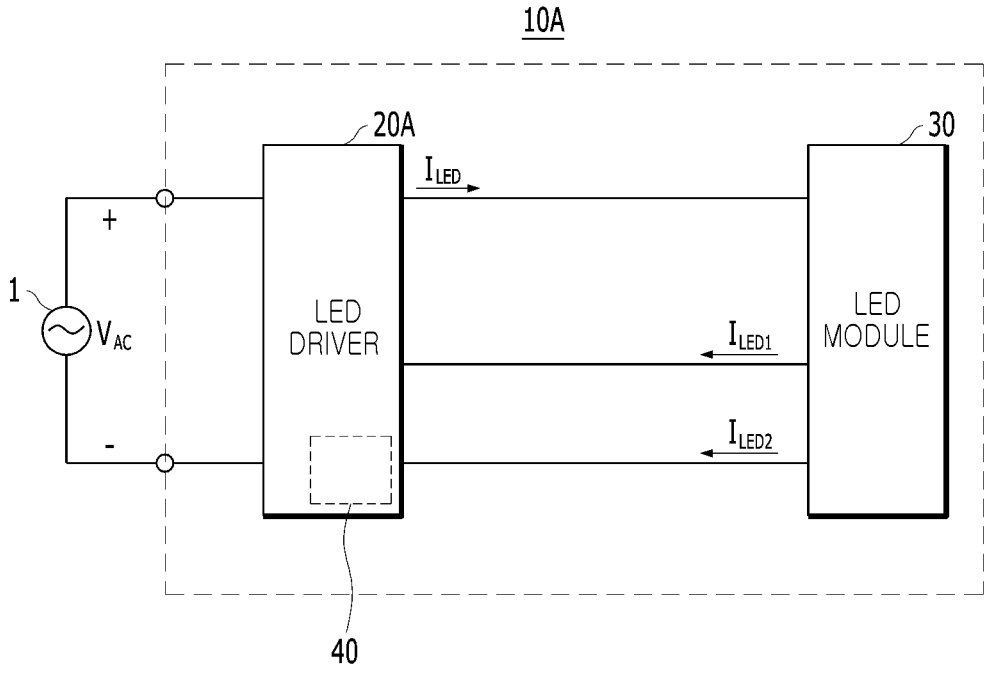
FIGS. 2A and 2B illustrate modified examples of the lighting device of FIG. 1.
Figure 2B:
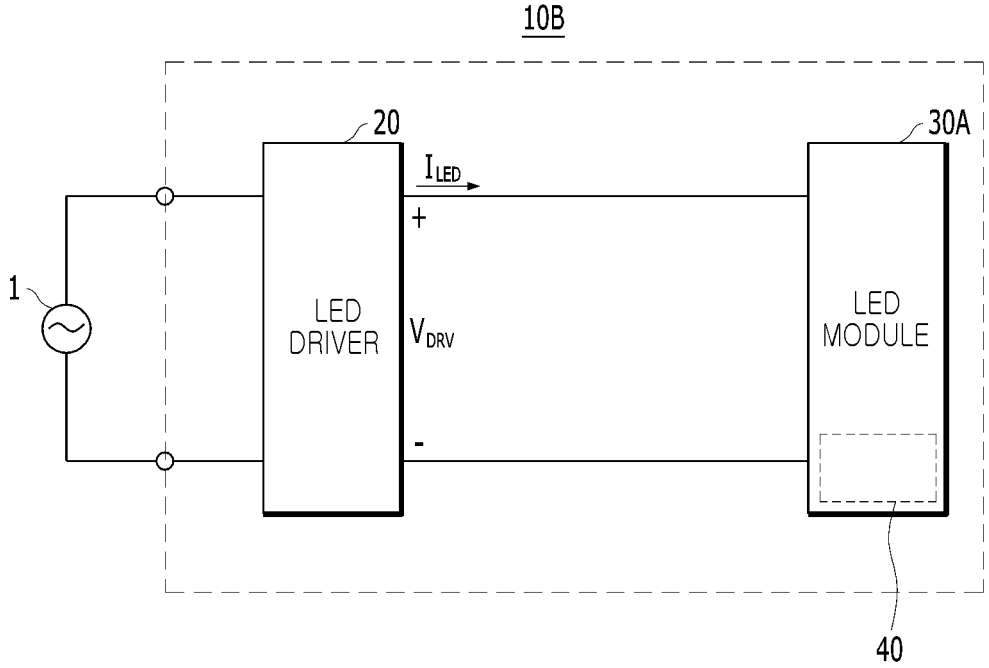

FIG. 1 is a block diagram schematically illustrating a lighting device according to an example embodiment, and FIGS. 2A and 2B illustrate modified examples of the lighting device of FIG. 1.

Referring to FIG. 1, a lighting device 10 according to an example embodiment may include an LED driver 20 connected to a power source 1, a LED module 30, and an LED control device 40. The LED driver 20 may receive AC power $V_{AC}$ output from the power source 1, and may output driving power $V_{DRV}$ for driving LEDs included in the LED module 30. For example, the LED driver 20 may output a driving current $I_{LED}$ for driving the LEDs, as a constant current. The LED driver 20 may output the driving power $V_{DRV}$ through a first driving node 21 and a second driving node 22.

The LED driver 20 may include a rectifier circuit rectifying the AC power $V_{AC}$ output from the power source (1) into a DC power source, a converter circuit generating driving power $V_{DRV}$ using rectified DC power, and the like. In some example embodiments, an Electro-Magnetic Interference (EMI) filter or the like may be further connected between the power source 1 and the rectifier circuit. The structure and operation of the LED driver 20 will be described later.

The LED module 30 includes a plurality of LEDs, and the plurality of LEDs may provide at least two LED strings having different color temperatures. For example, the plurality of LEDs may include first LEDs emitting light of a first color temperature and second LEDs emitting light of a second color temperature, different from the first color temperature. For example, the first LEDs may output a cool white type light, and the second LEDs may output a warm white type light. The first LEDs may provide at least one first LED string and the second LEDs may provide at least one second LED string. The first LED string and the second LED string may be connected to each other in parallel. However, the number of LED strings included in the LED module 30 is not necessarily limited to two.

The LED control device 40 may include a power supply, a square wave generator, a duty ratio controller, a switch, and the like. The power supply may generate an internal power supply voltage required to operate the square wave generator and the switch using the driving power supply $V_{DRV}$, and the square wave generator may generate a square wave having a constant period and wavelength. The duty ratio controller may transform the square wave output from the square wave generator into a triangular wave, and output the triangular wave as a control signal for controlling the switch. The switch may operate in response to a control signal of the duty ratio controller. For example, the switch may be directly connected to the LED module 30, and may control a plurality of LEDs included in the LED module 30 in response to the control signal.

According to an example embodiment, the LED control device may control a current ratio of a first current $I_{LED1}$ flowing through a first LED string and a second current $I_{LED2}$ flowing through a second LED string, included in the LED module 30, thereby adjusting the color temperature of the light emitted from the LED module 30. However, the number of LED strings included in the LED module 30 is not necessarily limited to two. As such, according to another example embodiment, the LED control device may control a current ratio of currents flowing through each of a plurality LED strings included in the LED module 30, thereby adjusting the color temperature of the light emitted from the LED module 30.

In the example embodiment illustrated in FIG. 1, the LED control device 40 may be implemented on a package substrate separate from that of the LED driver 20 and the LED module 30. Therefore, an LED control device 40 may be selectively added to the existing lighting device implemented with the LED driver 20 and the LED module 30, and additional functions provided by the LED control device 40 may be implemented in the lighting device, using the parts of the existing lighting device as it is.

However, the disclosure is not limited thereto, and depending on example embodiment, the LED control device 40 may be included in the LED driver 20 or the LED module 30. For example, as illustrated in FIG. 2A, the LED control device 40 may be implemented on a single package substrate together with an LED driver 20A of a lighting device 10A. In addition, as illustrated in FIG. 2B, the LED control device 40 may also be implemented on a single package substrate together with a LED module 30A of a lighting device 10B.

Figure 3:
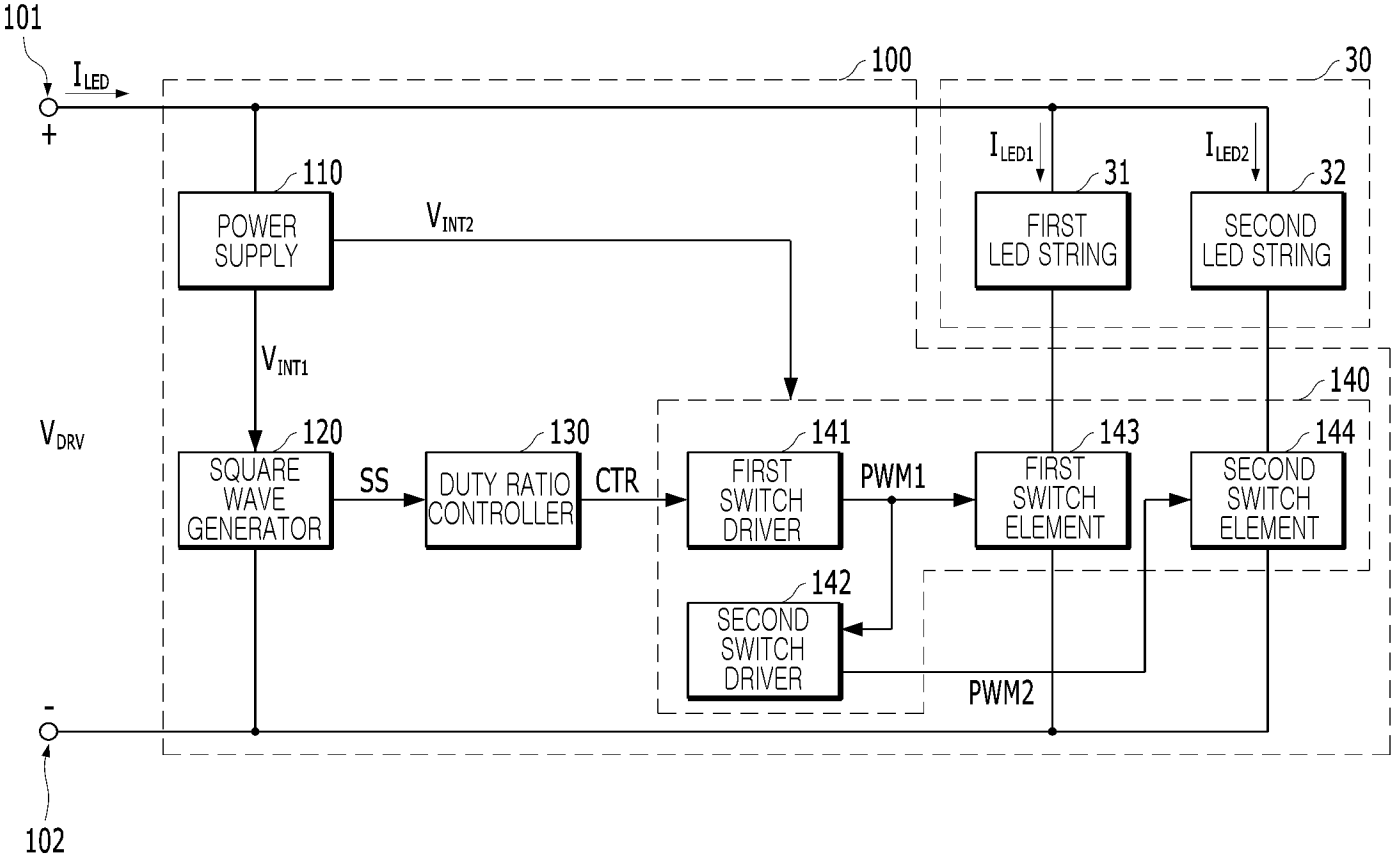
FIG. 3 is a block diagram schematically illustrating an LED control device according to an example embodiment.
Figure 4:
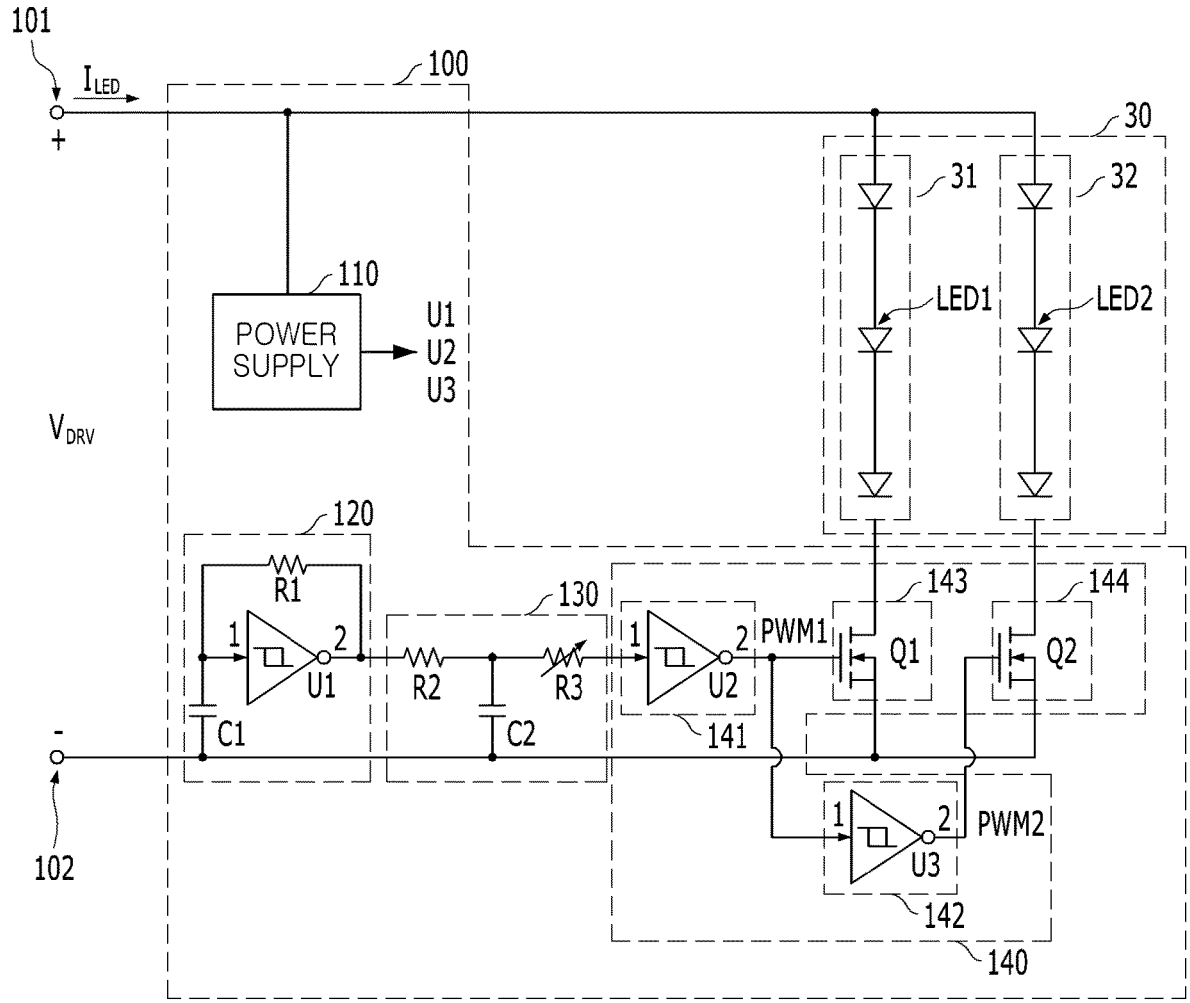
FIG. 4 is a block diagram illustrating in detail a partial configuration of the LED control device of FIG. 3.

FIG. 3 is a block diagram schematically illustrating an LED control device according to an example embodiment, and FIG. 4 is a block diagram illustrating in detail some configurations of the LED control device of FIG. 3. The LED control device 100 of FIG. 3 is an example of the LED control device 40 illustrated in FIG. 1.

Referring to FIGS. 3 and 4, the LED control device 100 according to an example embodiment may include a power supply 110, a square wave generator 120, a duty ratio controller 130, a switch circuit 140. However, the disclosure is not limited thereto, and as such, according to another example embodiment, the LED control device 100 may include other components, and the like.

The power supply 110 may generate internal power supply voltages $V_{INT1}$ and $V_{INT2}$ for the operation of the square wave generator 120 and the switch circuit 140 by using the driving power $V_{DRV}$ output from the LED driver. For example, the power supply 110 may generate internal power supply voltages $V_{INT1}$ for operating the square wave generator 120 and $V_{INT2}$ for operating the switch circuit 140. In some example embodiments, the operating voltage of the square wave generator 120 and the operating voltage of the switch circuit 140 may be different from each other, and the power supply 110 may supply first internal power supply voltage $V_{INT1}$ to the square wave generator 120, and supply second internal power supply voltage $V_{INT2}$ to the switch circuit 140. The power supply 110 may include a first regulator generating the first internal power supply voltage VINT' and a second regulator generating the second internal power supply voltage $V_{INT2}$.

The square wave generator 120 may operate by receiving the first internal power supply voltage $V_{INT1}$, and may generate a square wave SS having a specific cycle and wavelength. According to an example embodiment, the specific cycle and wavelength may be predetermined. The square wave generator 120 may include a first Schmitt trigger inverter U1, a first capacitor C1, and a first resistor R1. The first capacitor C1 may be connected between a second driving node 102 and an input terminal of the first Schmitt trigger inverter U1. The first resistor R1 is a feedback resistor, is connected to an output terminal of the first capacitor C1, and may be connected to the first Schmitt trigger inverter U1 in parallel. In FIG. 4, an input node of the Schmitt trigger inverter is labeled as "1" and an output node of the Schmitt trigger inverter is labeled as "2".

The square wave generator 120 of an example embodiment has an advantage in that a circuit may be configured with a relatively small number of components. In addition, the square wave generator 120 of an example embodiment may set the frequency of the square wave SS generated through a time constant determined by the resistance component of the first resistor R1 and the capacitor component of the first capacitor C1. Accordingly, the square wave generator 120 according to an example embodiment may change the frequency of the square wave SS only by changing the time constants of the first capacitor C1 and the first resistor R1. Therefore, when acoustic noise is generated from the LED module 30, by changing the frequency of the square wave SS to several tens of kHz or more, noise generated using the square wave SS of a specific frequency band may be eliminated. Therefore, the square wave generator 120 according to an example embodiment may supply the square wave SS in a relatively wider variable frequency range compared to the case of generating a square wave using a separate microcontroller.

The duty ratio controller 130 may be provided between the output terminal of the square wave generator 120 and the input terminal of the switch circuit 140. The duty ratio controller 130 may change the square wave SS output from the square wave generator 120 into a triangular wave and output the triangular wave as a control signal CTR for controlling the switch circuit 140, and may change the slope of the triangular wave. The duty ratio controller 130 may be a T filter having three nodes, and a second resistor R2, a second capacitor C2, and a first variable resistor R3 may be provided at respective nodes. The second resistor R2 may be connected to the output terminal of the square wave generator 120, and the second capacitor C2 may be connected between the second resistor R2 and the second driving node 102. The first variable resistor R3 may be connected between the second capacitor C2 and the input terminal of the switch circuit 140. The duty ratio controller 130 according to an example embodiment may convert the square wave input to the duty ratio controller 130 into a triangular wave through a time constant determined by the resistance component of the second resistor R2 and the capacitor component of the second capacitor C2. Also, the duty ratio controller 130 may change the slope of the triangular wave output by changing the size of the first variable resistor R3. When the slope of the triangular wave output from the duty ratio controller 130 is changed, the time for the Schmitt trigger inverter to reach the trigger level may be adjusted by the control signal CTR input to the Schmitt trigger inverter included in the switch circuit 140 connected to the output terminal, and therefore, the duty ratio of the PWM signal supplied to the LED module 30 may be adjusted, which will be described later. The first variable resistor R3 may be implemented as one variable resistance element, but the disclosure is not limited thereto. For example, as illustrated in FIG. 5, the first variable resistor may include one third resistor R3-1, and a plurality of resistors R3-2, R3-3 and R3-4 provided in parallel with the third resistor R3-1 and selectable by a switch.

The switch circuit 140 is connected to the LED module 30, and controls a current ratio of a first current $I_{LED1}$ flowing through a first LED string 31 and a second current $I_{LED2}$ flowing through a second LED string 32, included in the LED module 30, thereby adjusting the color temperature of the light emitted from the LED module 30. The LED module 30 may include the first LED string 31 and the second LED string 32 connected to each other in parallel. The first LED string 31 may include first LEDs LED1, and the second LED string 32 may include second LEDs LED2. For example, the first LED string 31 may output a cool white type light, and the second LED string 32 may output a warm white type light.

The switch circuit 140 may include switch drivers 141 and 142 and a switch elements 143 and 144. The switch drivers 141 and 142 may generate a pulse width modulation (PWM) signal for controlling on/off switching of the switch elements according to the control signal CTR input from the duty ratio controller 130. In switch elements 143 and 144, the turn-on time and turn-off time may be determined by the duty ratio of the PWM signal of the switch drivers 141 and 142.

The switch elements 143 and 144 may be turned on/off according to the PWM signal of the switch driver to control the current applied to the LED module 30. The switch drivers 141 and 142 and the switch elements 143 and 144 may be provided in a number corresponding to the number of LED strings included in the LED module 30, respectively. According to an example embodiment, the switch elements 143 and 144 may be transistors, such as metal-oxide-semiconductor field-effect transistor (MOSFET). However, the disclosure is not limited thereto, and as such, other types of switches may be provided as switch elements 143 and 144.

In an example embodiment, the switch drivers 141 and 142 may include a first switch driver 141 and a second switch driver 142. The first switch driver 141 may output a first PWM signal PWM1 for controlling the first switch element 143, and the second switch driver 142 may output a second PWM signal PWM2 for controlling the second switch element 144. The switch elements 143 and 144 may include a first switch element 143 controlled by the first switch driver 141, and a second switch element 144 controlled by the second switch driver 142.

The first switch driver 141 and the second switch driver 142 may include one Schmitt trigger inverter U2, U3, respectively. For example, the first switch driver 141 may include a second Schmitt trigger inverter U2, and the second switch driver 142 may include a third Schmitt trigger inverter U3. The second Schmitt-trigger inverter U2 and the third Schmitt-trigger inverter U3 may be the same-type element. In the case of the first switch driver 141, the timing at which the first switch driver 141 reaches the trigger level is changed depending on the slope of the control signal CTR input from the duty ratio controller 130, and therefore, a duty ratio of the first PWM signal PWM1 output from the first switch driver 141 may be varied. For example, when the slope of the input control signal CTR is steep, the time for the first switch driver 141 to reach the trigger level is relatively shortened, and thus, the duty ratio of the first PWM signal PWM1 is reduced. On the other hand, when the slope of the control signal CTR is gentle, the time for the first switch driver 141 to reach the trigger level increases, and thus, the duty ratio of the first PWM signal PWM1 increases.

The second switch driver 142 may invert and output the first PWM signal PWM1 output from the first switch driver 141. For example, the second switch driver 142 may output the second PWM signal PWM2 having the opposite phase to the first PWM signal PWM1 and having the same magnitude. Accordingly, when the duty ratio of the first PWM signal PWM1 increases, the duty ratio of the second PWM signal PWM2 decreases. When the duty ratio of the first PWM signal PWM1 decreases, the duty ratio of the second PWM signal PWM2 increases. Since the first LED string 31 and the second LED string 32 are driven complementarily by the first switch driver 141 and the second switch driver 142, the color temperature of light emitted by the LED module 30 may be adjusted.

FIGS. 6A, 6B, 7A, 7B, 7C, 8A, 8B and 8C are diagrams illustrating signals output from respective parts of the LED control device according to an example embodiment.

A signal output from each part of the LED control device 40 will be described with reference to FIGS. 4 and 6A, 6B, 7A, 7B, 7C, 8A, 8B and 8C.

FIG. 6A is a diagram illustrating a square wave output from the square wave generator 120 of FIG. 4. The frequency of the square wave output from the first Schmitt trigger inverter U1 of the square wave generator 120 may be set through the + trigger level and the − trigger level of the first Schmitt trigger inverter U1, the resistance component of the first resistor R1, and the capacitor component of the second capacitor C2. In a case in which the frequency of the square wave is set to a low frequency of several hundred Hz or less, a flicker phenomenon in which light emitted from the LED module 30 flickers finely, or a shimmer phenomenon in which light emitted from the LED module 30 vibrates may occur. In this case, this phenomenon may be reduced or prevented by increasing the frequency of the square wave.

FIG. 6B is a diagram illustrating a voltage applied to both ends of the second capacitor C2 of the duty ratio controller 130 of FIG. 4. It can be seen that the square wave output from the square wave generator 120 is integrated and a triangular wave is output.

Figure 7A:
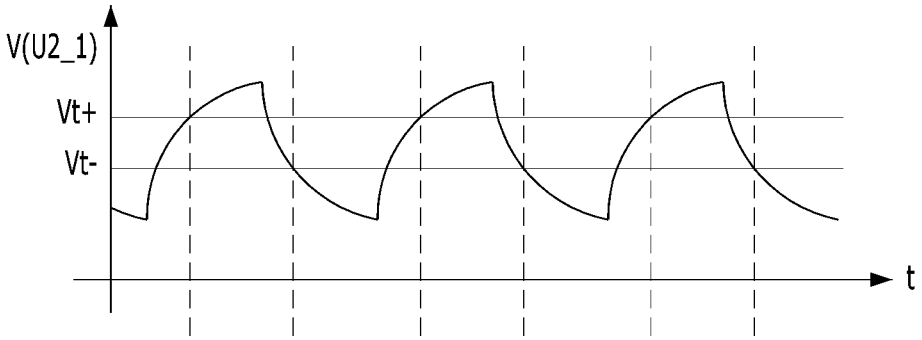
Figure 7B:
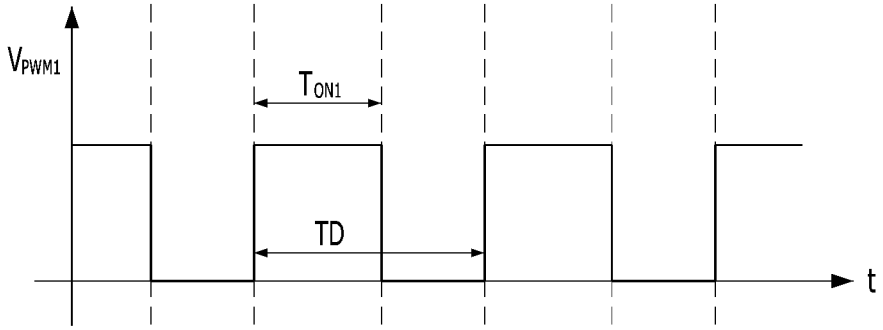

FIG. 7A is a diagram illustrating the control signal CTR input to an input terminal of the first switch driver 141. The control signal CTR input to the first switch driver 141 may be triggered at the + trigger level (Vt+) and − trigger level (Vt−) of the second Schmitt trigger inverter U2 included in the first switch driver 141, and may be output as a first PWM signal PWM1 to an output terminal of the first switch driver 141. The first PWM signal PWM1 may turn on the first switch element 143 during a first turn-on time $T_{ON1}$ of a period TD.

Figure 7C:
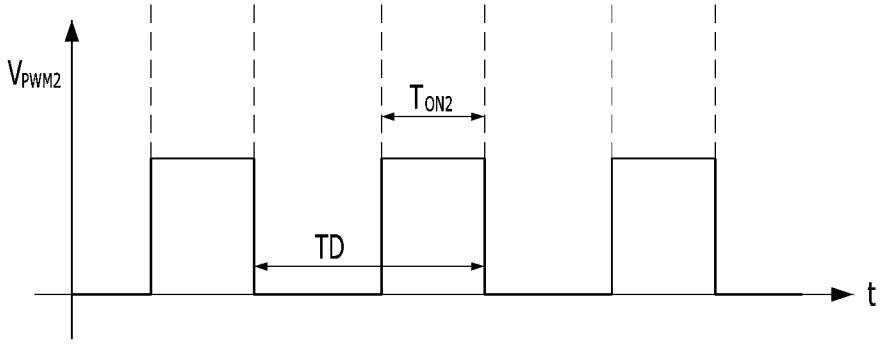

The second switch driver 142 may be connected to an output terminal of the first switch driver 141 to receive the first PWM signal PWM1 output from the first switch driver 141. The second switch driver 142 may invert the first PWM signal PWM1 to output the second PWM signal PWM2. As illustrated in FIG. 7C, the second PWM signal PWM2 is a signal provided by inverting the first PWM signal PWM1, and thus, may turn on the second switch element 144 during a second turn-on time $T_{ON2}$ of the period TD except for the first turn-on time Torn. Since the first switch element 143 and the second switch element 144 are turned on complementary to each other, the first LED string 31 and the second LED string 32 in which the current is controlled by the first switch element 143 and the second switch element 144 may also be turned on complementarily.

Next, with reference to FIGS. 8A to 8C, a process in which currents applied to the first LED string 31 and the second LED string 32 change as the slope of the control signal CTR changes will be described.

Figure 8A:
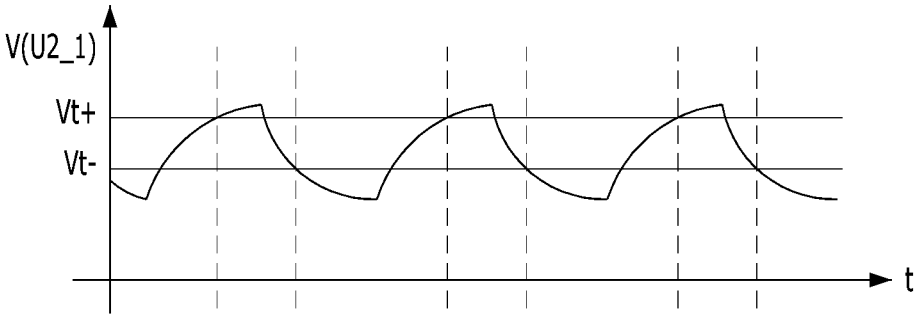
Figure 8B:
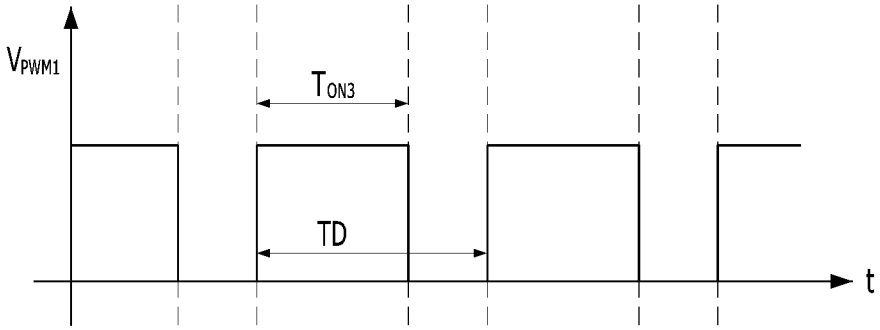
Figure 8C:
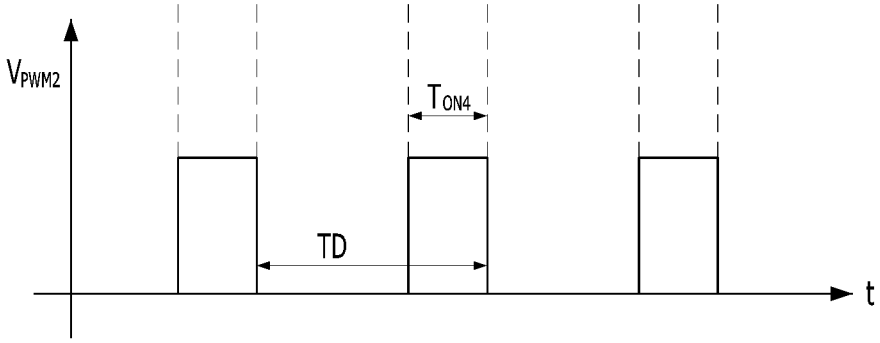

FIG. 8A is a diagram illustrating a control signal CTR input to the input terminal of the first switch driver 141. Compared to the control signal CTR illustrated in FIG. 7A described above, it can be seen that there is a difference in that the slope of CTR is reduced. In the control signal CTR illustrated in FIG. 8A, the amplitude of the triangular wave is reduced and the slope becomes smoother than the control signal CTR illustrated in FIG. 7A. In addition, it can be seen that the timing of triggering by the + trigger level (Vt+) and the − trigger level (Vt−) is changed compared to the control signal CTR of FIG. 7A. In detail, the time of reaching the + trigger level Vt+ is delayed, and thus, compared to FIG. 7B, in the case of the first PWM signal PWM1, it can be seen that a third turn-on time $T_{ON3}$, which is a time during which the first switch element 143 is turned on during the period TD, increases, compared to the first PWM signal PWM1 of FIG. 7B described above. Accordingly, when the slope of the control signal CTR becomes gentle, it can be seen that the turn-on time of the first PWM signal PWM1 increases. On the other hand, it can be seen that a fourth turn-on time $T_{ON4}$, which is the turn-on time of the second PWM signal PWM2, is reduced compared to the second turn-on time $T_{ON2}$ of FIG. 7C described above. Accordingly, when the slope of the control signal CTR becomes gentle, it can be seen that the turn-on time of the second PWM signal PWM2 decreases. Thus, it can be seen that the turn-on time of the first LED string 31 and the second LED string 32 may be adjusted by changing the slope of the triangular wave included in the control signal CTR.

Figure 9:
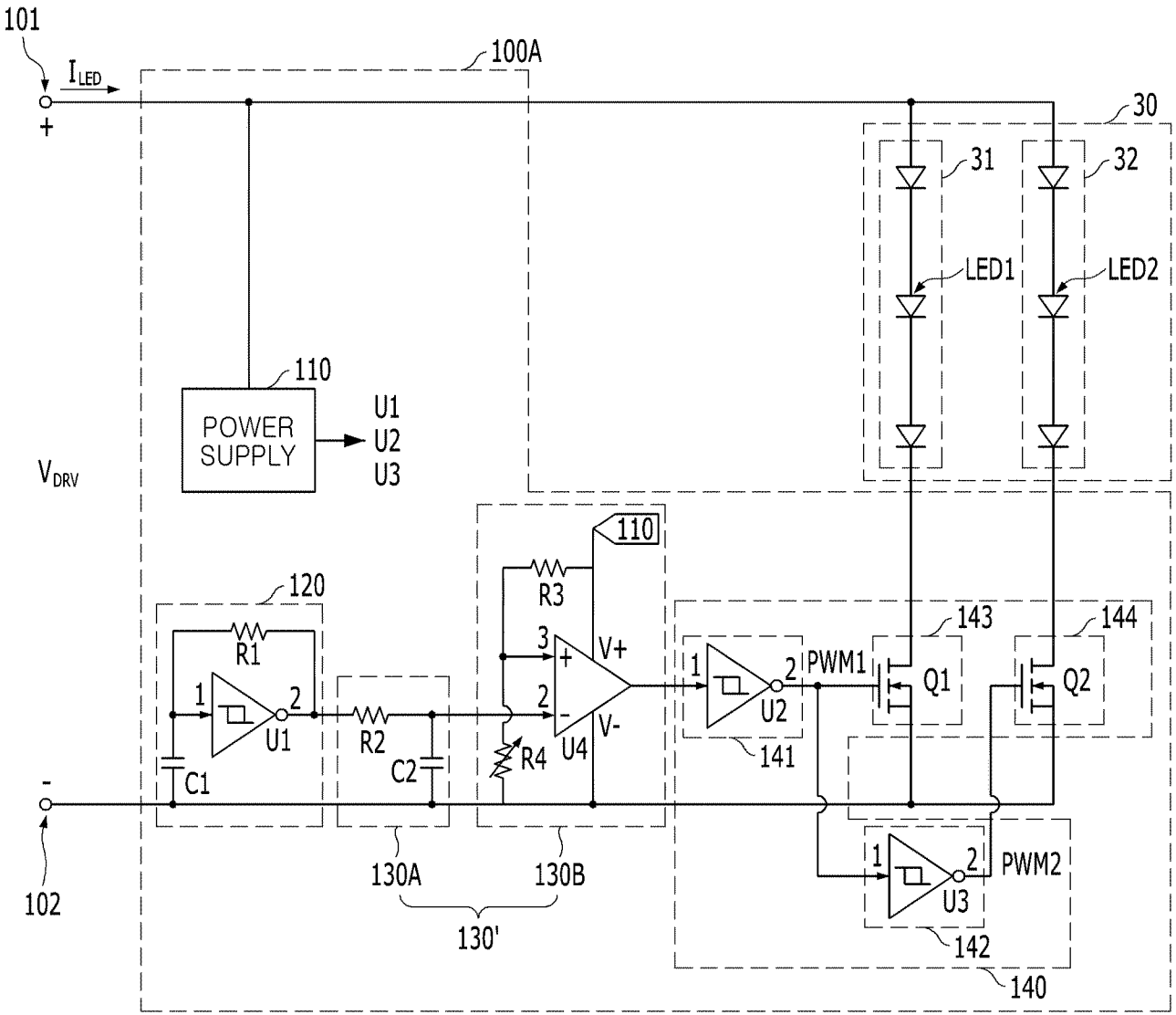
FIG. 9 is a block diagram schematically illustrating an LED control device according to an example embodiment.

FIG. 9 is a block diagram schematically illustrating an LED control device according to an example embodiment, and FIGS. 10A to 10D are diagrams illustrating the signals output from respective parts of the LED control device according to an example embodiment.

An LED control device 100A illustrated in FIG. 9 is different the LED control device 100 of FIG. 3 in that a duty ratio controller 130' is different from the duty ratio controller 130 of the LED control device 100 of FIG. 3 described above. Since other configurations are the same as those of the LED control device 100 described in FIG. 3, a detailed description thereof will be omitted.

The duty ratio controller 130' according to an example embodiment has a difference in that a low-pass filter 130A and a comparator 130B are included. Compared with the duty ratio controller 130 of the above-described embodiment, a comparator is further included, and thus, power should be additionally applied through the power supply 110, but compared to the LED control device of the above-described embodiment, there is an advantage in that the duty ratio may be more precisely controlled, compared to the LED control device of the above-described embodiment, which will be described with reference to FIGS. 10A to 10D.

Figure 10A:
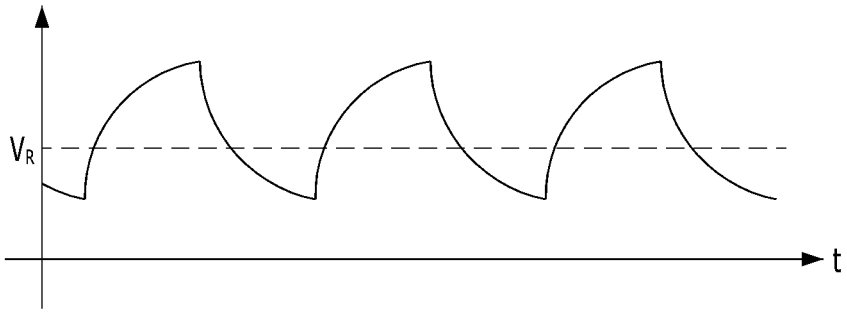
FIGS. 10A, 10B, 10C, and 10D are diagrams illustrating signals output from respective parts of an LED control device according to an example embodiment.
Figure 10B:
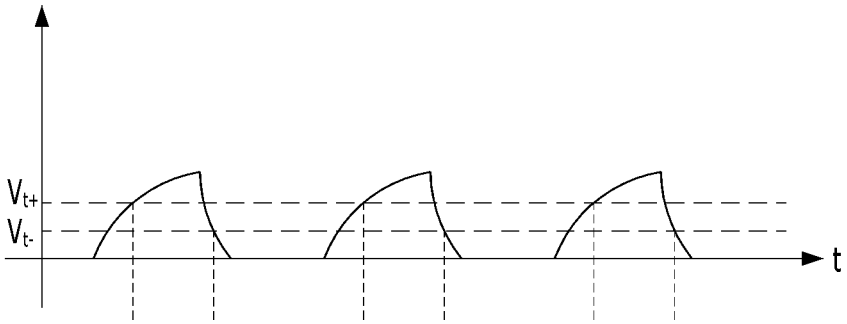
Figure 10C:
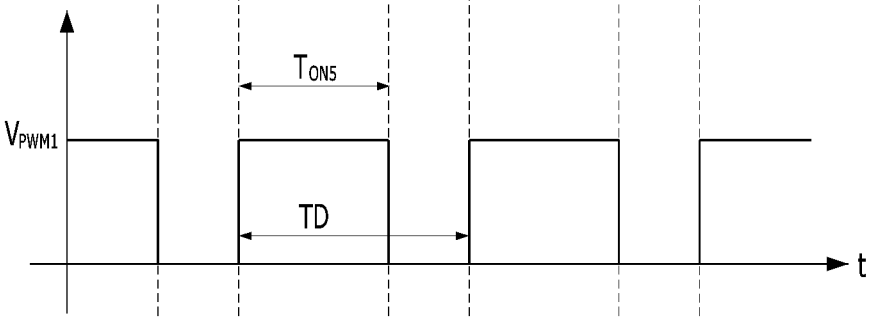
Figure 10D:
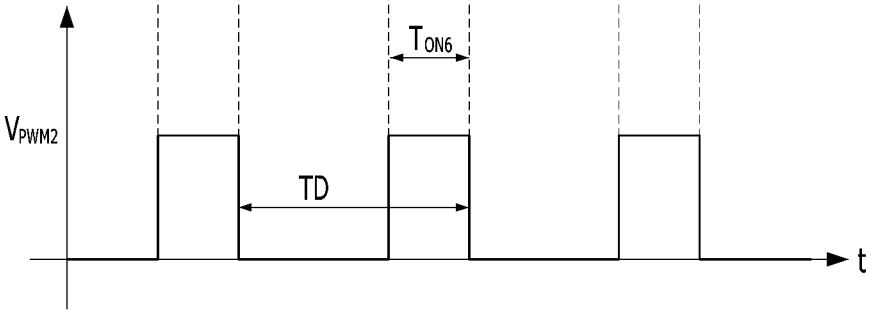

FIG. 10A is a diagram illustrating a voltage applied to the low-pass filter 130A. $V_R$ illustrates the reference potential applied to a comparator 130B. FIG. 10B is a diagram illustrating a control signal CTR output from an output terminal of the comparator 130B. It can be seen that the voltage component having a magnitude lower than the reference potential $V_R$ of the comparator 130B is removed, and thus, only the upper signal of the triangular wave is output. While in the above-described embodiment, the control signal CTR input to the first switch driver 141 is adjusted by changing only the slope of the control signal CTR, in an example embodiment, there is a difference in that the control signal CTR input to the first switch driver 141 is adjusted using the slope of the control signal CTR and the reference potential $V_R$ of the comparator 130B. The timing at which the first switch driver 141 reaches the trigger level may be determined by the slope of the control signal CTR and the reference potential $V_R$ of the comparator 130B. Accordingly, a fifth turn-on time $T_{ON5}$ which is the turn-on time of the first PWM signal PWM1 and a sixth turn-on time $T_{ON6}$ which is the turn-on time of the second PWM signal PWM2 according to an example embodiment are adjusted by the slope of the control signal CTR and the reference potential $V_R$ of the comparator 130B, and therefore, there is an advantage in which the duty ratio may be controlled more precisely compared to the LED control device of the afore-described embodiment.

As set forth above, according to an example embodiment, without the need to exchange or upgrade the LED driver or the like included in the existing lighting device, a color temperature control function of the lighting device may be additionally implemented by connecting the LED control device to the driving nodes connecting the LED driver and the LED module. Accordingly, a lighting device significantly improving user convenience while significantly reducing waste of existing installed devices may be implemented.

At least one of the components, elements, modules and units (collectively "components" in this paragraph) represented by a block in the drawings may be embodied as various numbers of hardware, software and/or firmware structures that execute respective functions described above, according to an example embodiment. These components may include at least the square wave generator 120 and the duty ratio controller 130 shown in FIG. 3, not being limited thereto. According to example embodiments, at least one of these components may use a direct circuit structure, such as a memory, a processor, a logic circuit, a look-up table, etc. that may execute the respective functions through controls of one or more microprocessors. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like.

While example embodiments have been illustrated and described above, it will be apparent to those skilled in the art that modifications and variations could be made without departing from the scope of the disclosure as defined by the appended claims.

What is claimed is:

1. A light emitting diode (LED) control device comprising:

a power supply connected to a first driving node and a second driving node through which an LED driver is configured to supply power to an LED module which comprises a first LED string configured to output light of a first color temperature and a second LED string configured to output light of a second color temperature;

a square wave generator configured to operate based on a first internal power supply voltage output from the power supply and generate a square wave;

a duty ratio controller configured to output a control signal based on the square wave, and change a slope of the control signal based on a change in a time constant; and a switch circuit configured to operate based on a second internal power supply voltage output from the power supply, and control a ratio of a first current applied to the first LED string and a second current applied to the second LED string based on a change in the slope of the control signal.

2. The LED control device of claim 1, wherein the switch circuit comprises:

a plurality of switch elements provided between the LED module and the second driving node, the plurality of switch elements comprising a first switch element configured to control the first current supplied to the first LED string and a second switch element configured to control the second current supplied to the second LED strings, and a plurality of switch drivers between the duty ratio controller and the plurality of switch elements, the plurality of switch drivers configured to operate based on the second internal power supply voltage, and comprising a first switch driver configured to output a first pulse width modulation (PWM) signal for controlling the first switch element based on the control signal, and a second switch driver connected to an output terminal of the first switch driver and configured to receive the first PWM signal and output a second PWM signal inverted from the first PWM signal to control the second switch element.

3. The LED control device of claim 2, wherein the first PWM signal and the second PWM signal have opposite phases and have a same magnitude.

4. The LED control device of claim 2, wherein when the first switch element is turned on, the second switch element is turned off, and when the second switch element is turned on, the first switch element is turned off.

5. The LED control device of claim 1, wherein the square wave generator comprises:

a first Schmitt trigger inverter connected to an input terminal of the duty ratio controller, a first capacitor connecting the input terminal of the first Schmitt trigger inverter and the second driving node, and a first resistance element connecting the input terminal and an output terminal of the first Schmitt trigger inverter, and wherein a frequency of the square wave is determined by a time constant determined by a resistance component of the first resistance element and a capacitor component of the first capacitor.

6. The LED control device of claim 2, wherein the duty ratio controller comprises:

a second resistance element connected to an output terminal of the square wave generator, a second capacitor element connected between the second resistance element and the second driving node, and a first variable resistance element connecting the second resistance element and the first switch driver, and wherein the time constant changes according to a change in a resistance component of the first variable resistance element.

7. The LED control device of claim 2, wherein the duty ratio controller comprises:

a low-pass filter connected to an output terminal of the square wave generator, and a comparator connecting the low-pass filter and the plurality of switch elements, wherein the low-pass filter comprises a second resistance element connected to the output terminal of the square wave generator, and a second capacitor element connected between the second resistance element and the second driving node, and wherein the time constant is determined by a resistance component of the second resistance element and a capacitor component of the second capacitor element.

8. The LED control device of claim 2, wherein the first switch driver comprises a second Schmitt trigger inverter and the second switch driver comprises a third Schmitt trigger inverter.

9. The LED control device of claim 8, wherein the second and third Schmitt trigger inverters are a same type.

10. The LED control device of claim 1, wherein the power supply comprises:

a first regulator generating the first internal power supply voltage, and a second regulator generating the second internal power supply voltage, wherein the first internal power supply voltage has a magnitude different from the second internal power supply voltage.

11. Alight emitting diode (LED) control device comprising:

a power supply connected to a first driving node and a second driving node through which an LED driver is configured to supply power to an LED module which comprises a first LED string and a second LED string connected to each other in parallel and configured to emit light having different color temperatures;

a square wave generator configured to generate a square wave;

a duty ratio controller configured to output a control signal based on the square wave, and change a slope of the control signal based on a change in a time constant; and a switch circuit comprising:

a first switch driver configured to output a first pulse width modulation (PWM) signal of which trigger timing is changed according to a change in the slope of the control signal output from the duty ratio controller, a second switch driver configured to invert the first PWM signal into a second PWM signal, and output the second PWM signal, a first switch element configured to control a first current supplied to the first LED strings based on the first PWM signal, and a second switch element configured to control a second current supplied to the second LED strings based on the second PWM signal.

12. The LED control device of claim 11, wherein the first and second switch drivers each comprise a Schmitt trigger inverter.

13. The LED control device of claim 11, wherein the duty ratio controller comprises:

a resistance element connected to an output terminal of the square wave generator, a capacitor element connected between the resistance element and the second driving node, and a first variable resistance element connecting the resistance element and the first switch driver, and wherein the slope of the control signal is changed based on a change in a resistance component of the first variable resistance element.

14. The LED control device of claim 11, wherein the duty ratio controller comprises:

a low-pass filter connected to an output terminal of the square wave generator, and a comparator connecting the low-pass filter and the first switch driver, wherein the low-pass filter comprises a resistance element connected to the output terminal of the square wave generator, and a capacitor element connected between the resistance element and the second driving node, and wherein the slope of the control signal is determined by a resistance component of the resistance element and a capacitor component of the capacitor element.

15. A lighting device comprising:

a light emitting diode (LED) driver configured to generate a driving power for driving LEDs using alternating current (AC) power and output the driving power through a first driving node and a second driving node;

an LED module configured to be turned on by the driving power, and comprising a first LED string configured to emit light of a first color temperature and a second LED string configured to emit light of a second color temperature; and an LED control device comprising:

a power supply connected to the first driving node and the second driving node, a square wave generator configured to generate a square wave, a duty ratio controller configured to output a control signal based on the square wave, and change a slope of the control signal based on a change in a time constant, and a switch circuit configured to control a ratio of a first current applied to the first LED string and a second current applied to the second LED string based on a change in the slope of the control signal.

16. The lighting device of claim 15, wherein the switch circuit comprises:

a plurality of switch elements provided between the LED module and the second driving node, and comprising a first switch element configured to control the first current supplied to the first LED string and a second switch element configured to control the second current supplied to the second LED strings, and a plurality of switch drivers provided between the duty ratio controller and the plurality of switch elements, the plurality of switch drivers comprising a first switch driver configured to output a first pulse width modulation (PWM) signal for controlling the first switch element based on the control signal and a second switch driver connected to an output terminal of the first switch driver and configured to receive the first PWM signal and output a second PWM signal inverted from the first PWM signal to control the second switch element.

17. The lighting device of claim 16, wherein when the first LED string is turned on, the second LED string is turned off, and when the second LED string is turned on, the first LED string is turned off.

18. The lighting device of claim 16, wherein the duty ratio controller comprises:

a resistance element connected to an output terminal of the square wave generator, a capacitor element connected between the resistance element and the second driving node, and a first variable resistance element connecting the resistance element and the first switch driver, and wherein the time constant changes according to a change in a resistance component of the first variable resistance element.

19. The lighting device of claim 16, wherein the duty ratio controller comprises:

a low-pass filter connected to an output terminal of the square wave generator, and a comparator connecting the low-pass filter and the switch circuit, wherein the low-pass filter comprises a resistance element connected to the output terminal of the square wave generator, and a capacitor connected between the resistance element and the second driving node, and wherein the time constant is determined by a resistance component of the resistance element and a capacitor component of the capacitor.

20. The lighting device of claim 15, wherein the LED driver comprises:

a rectifier circuit configured to rectify the AC power, and a converter circuit configured to generate the driving power using an output of the rectifier circuit.

* * * * *